United States Patent [19]

Tinnel

[11] Patent Number: 4,595,316

[45] Date of Patent: Jun. 17, 1986

[54] AUTOMATED TEMPORARY ROOF SUPPORT SYSTEM FOR MINING EQUIPMENT

[76] Inventor: Nelson E. Tinnel, Star Rte. 1, Box 12A, Summersville, W. Va. 26651

[21] Appl. No.: 608,652

[22] Filed: May 9, 1984

[51] Int. Cl.[4] ..... E21D 15/59; E21D 20/00; E21C 41/00

[52] U.S. Cl. ..... 405/291; 405/288; 299/11; 299/33

[58] Field of Search ..... 405/259, 288, 290, 291, 405/295, 297, 299, 300, 303; 299/11, 31, 33; 175/219; 173/22, 23, 38, 46

[56] References Cited

U.S. PATENT DOCUMENTS

| | | | |
|---|---|---|---|
| 2,766,012 | 10/1956 | Hale | 173/22 X |
| 2,799,249 | 7/1957 | Lear | 173/22 X |
| 3,003,602 | 10/1961 | Lester | 405/290 X |
| 3,849,995 | 11/1974 | Jamison | 299/11 X |
| 3,871,707 | 3/1975 | Jamison | 299/11 |
| 3,892,100 | 7/1975 | Jamison | 405/291 |
| 4,022,026 | 5/1977 | Childress . | |
| 4,050,259 | 9/1977 | Childress . | |
| 4,117,894 | 10/1978 | Saunders | 173/23 |
| 4,190,385 | 2/1980 | Childress | 405/288 |
| 4,199,193 | 4/1980 | Damron et al. | 299/31 |
| 4,252,475 | 2/1981 | Cobb et al. | 405/291 |
| 4,284,368 | 8/1981 | Albright | 405/291 |
| 4,420,277 | 12/1983 | Hibbard et al. | 405/303 X |

FOREIGN PATENT DOCUMENTS

| | | | |
|---|---|---|---|
| 806427 | 6/1951 | Fed. Rep. of Germany | 405/290 |
| 2815846 | 10/1979 | Fed. Rep. of Germany | 405/290 |

*Primary Examiner*—Cornelius J. Husar
*Assistant Examiner*—Nancy J. Stodola
*Attorney, Agent, or Firm*—Oblon, Fisher, Spivak, McClelland & Maier

[57] ABSTRACT

A lightweight jack for supporting the roof of a mine until permanent supports are in place. The jack is carried by a roof bolter or similar mining equipment on the end of a support arm. A hinge box is mounted on the sidewall of the roof bolter and one end of the arm is hingedly received therein. A support plate extends from the sidewall outwardly below the arm. The support plate carries at the far end a U-shaped bracket with a spring inside the bracket. The support arm rests on the spring when the jack is not extended. A swivel arm is received inside the support arm and held from turning by a swivel pin. When the pin is removed, the swivel arm and jack may be turned sideways for easy manuevering by the roof bolter.

7 Claims, 3 Drawing Figures

AUTOMATED TEMPORARY ROOF SUPPORT SYSTEM FOR MINING EQUIPMENT

BACKGROUND OF THE INVENTION

1. Field of the Invention

This invention relates to a mine roof support system and more particularly to a lightweight automated temporary roof support system carried by mobile mining equipment.

2. Description of the Prior Art

Ever since mining began, engineers have sought better methods of providing mine roof support. The dangers from cave-ins and even smaller amounts of rock breaking off the roof have always made this occupation one of the most hazardous. As a result, stricter standards are continually being enacted and enforced for the protection of mine workers.

Originally, wooden timbers cut to length and set upright provided the only roof support. While this system was considerably better than no support at all, it had several disadvantages. Since the timbers had to rest on the floor of the mine, they were often in the way, particularly when large machinery replaced manpower in the mines. Workers have often been caught and crushed between moving machines and the timbers.

A better method of support is currently used by suspending the roof from the more solid rock strata above it using roof bolts. Essentially, a hole is drilled into the roof and a long bolt inserted in it. A plate is placed over the end of the bolt and against the roof. As the bolt is tightened, an expansion nut at the upper end of the bolt expands, anchoring the bolt into the rock at that level and supporting the roof by the roof plate. Mobile roof bolting machines are now common in mines and provide a safe roof support system for the miners.

Unfortunately, the roof bolter operator, in his attempts to make the mine safe for others, now becomes the person most susceptible to injury. Rock falling from the roof either before the support can be installed or from the bolt installation process itself, can injure or kill the unsuspecting operator. In particular, statistics have shown that most of the accidents occur while positioning temporary supports in the form of timbers or metal jacks before installing the roof bolts. In response to this, states are beginning to enact regulations requiring bolting machines to be equipped with an automated temporary roof support (ATRS) which can position a temporary support from an area that already has permanent support. Several types of systems have been designed to implement this kind of protection.

U.S. Pat. No. 3,892,100 shows a self-propelled roof bolter having the capability of moving an extendable temporary roof support into place before the roof bolting operation. The temporary support is self-standing and carried into place by an arm having a hook at the front end. Once it is placed where desired, the support is hydraulically extended to the height of the roof and left there while the bolting operation progresses. After the roof is bolted there, the temporary support is moved to the next bolting location.

U.S. Pat. No. 4,252,475 shows another roof bolter machine having an ATRS system. The support is mounted on a boom on the front of a roof bolter. The support is pivotable by means of a hydraulic device in order to make movement of the machine easier. The boom is movable by means of another hydraulic device.

These devices and other forms of ATRS systems give additional protection to the operator of the roof bolter, but sometimes present additional problems. Devices which are detachable from the roof bolter can be cumbersome and may create a hazard in that they may slip from their position and fall. Other devices may require large amounts of space and power and also be expensive. Many otherwise usable devices have been designed into a bolter or other machine in such a way that it is not available for an easy retrofit onto existing machines.

Additional problems are involved where coal seams have low ceilings. Most equipment designed for a higher mine simply will not fit. Unfortunately, in some areas, these low seams provide the highest quality coal which is especially in demand for meeting pollution standards. It is not possible to merely size down larger machines since the individual components are weakened by the reduction in size while the stresses from the roof remain constant regardless of its height. Also, devices designed for higher seams may interfere with the working space and visibility in the tighter confines of a low seam. Accordingly, the use of such devices in low seams present many problems.

SUMMARY OF THE INVENTION

Accordingly, one object of this invention is to provide a novel temporary roof support for mining which is lightweight, strong and simple to operate.

Another object of this invention is to provide an automated temporary roof support for mining in a mine with a low roof.

A further object of this invention is to provide an automated temporary roof support for a mobile mine roof bolter which is convenient to operate.

A still further object of this invention is to provide an automated temporary roof support which is manueverable even in mines with low roofs.

Another object of this invention is to provide an automated temporary roof support system which is inexpensive to build and operate, requires little power, is manueverable in low roof mines and is easily retrofitted onto existing machines.

Briefly, these and other objects of this invention are achieved by providing an ATRS jack on the end of a supporting arm which is hinged in a box attached to the mining machine. A support plate also attached to the machine extends below the arm and supports it in a spring box. A swivel arm is carried inside the support arm and may turn therein upon removal of a pin so that the jack may be turned sideways for removal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
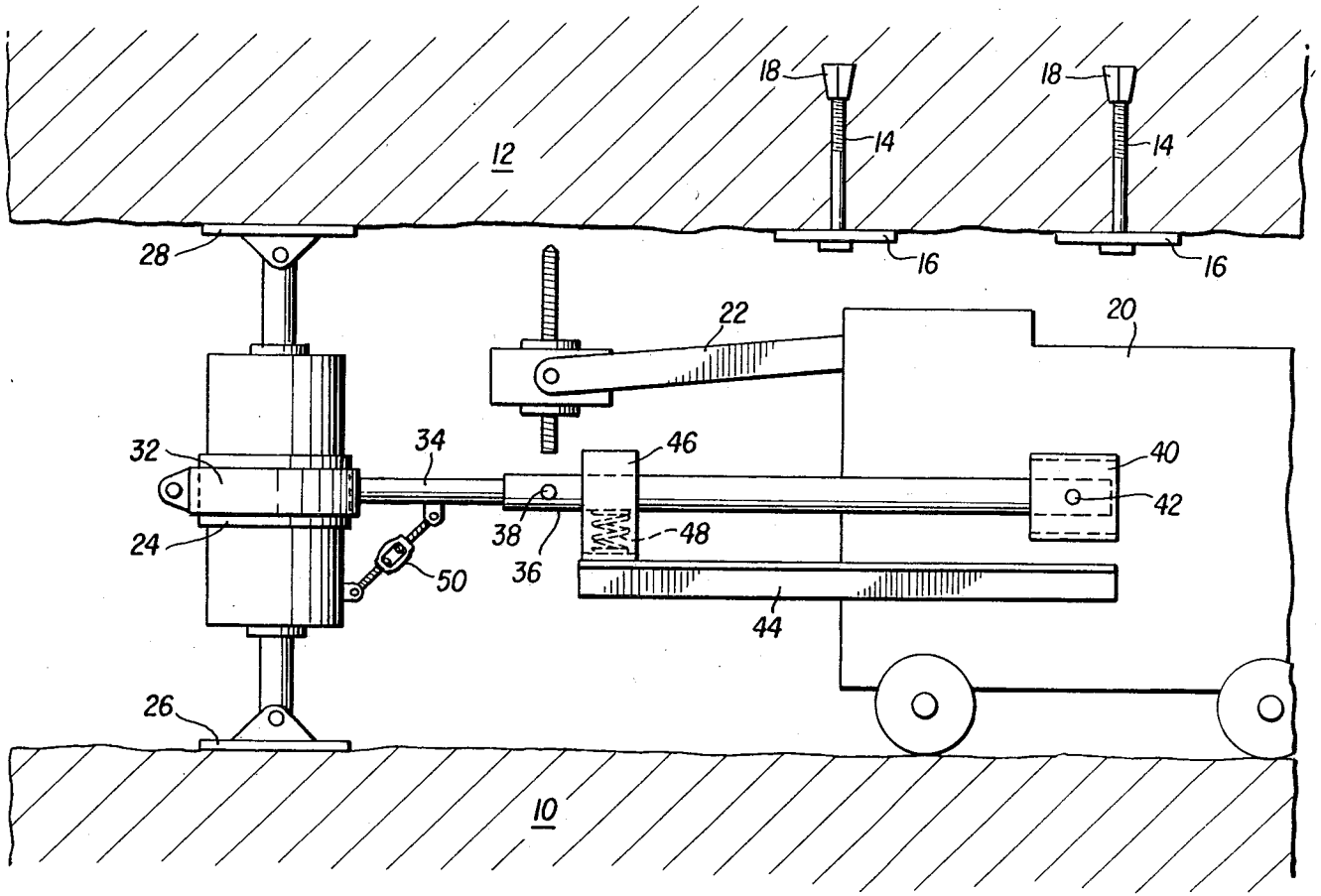
FIG. 1 is an elevational view of the present invention being used on a roof bolter in a mine.
Figure 2:
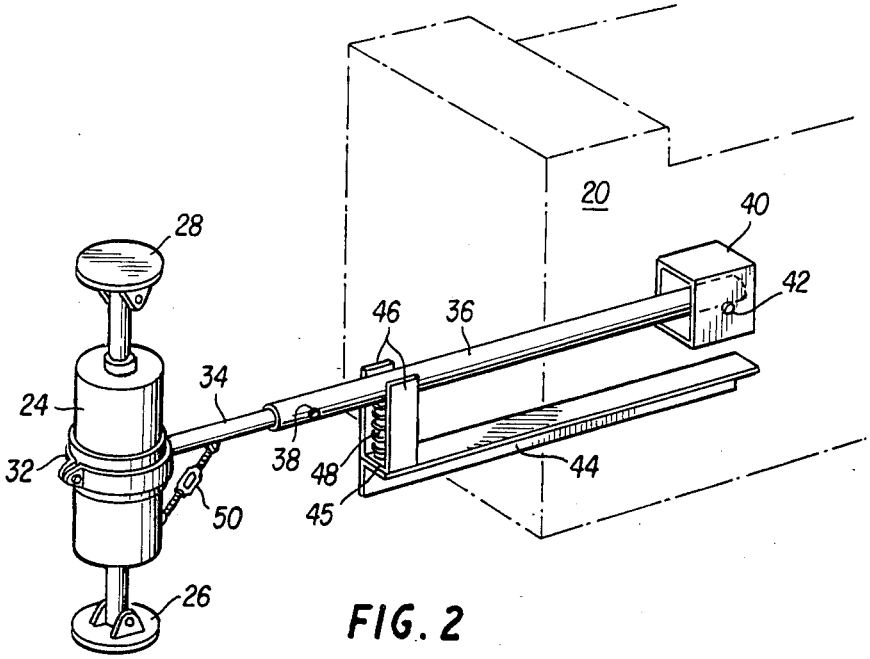
FIG. 2 is a schematic of the present invention.

Referring now to the drawings, wherein like reference numerals designate identical or corresponding parts throughout the several views, and more particularly to FIG. 1 thereof, wherein the present invention is shown as being attached to a roof bolter in a mine. The floor of the mine is designated as 10, while the roof of the mine is indicated by 12. Permanent roof supports in the form of roof bolts are located in the roof of the mine. After the drilling apparatus 22 on roof bolter machine 20 makes a hole in the roof, a bolt 14 is inserted therein. It carries an expansion nut 18 on its upper end and a roof plate on the lower end. As the bolt is tightened, the expansion nut grips the strata of rock holding the bolt and roof plate in place.

Roof bolter 20 also carries an automated temporary roof support (ATRS) system including a double acting, telescoping jack 24. Preferably, the jack is hydraulically operated, although it could be pneumatically operated or use other sources of power. The jack carries tiltable floor pad 26 at one end and a tiltable roof pad 28 at the other end. The jack may include a check valve and other safety devices for preventing undesired closings. Hoses or other power delivery devices are not shown.

A clamp 32 encircles the jack and grips it firmly. The clamp may be of any type, for example two metal semicircles which are bolted together at their meeting point. The clamp must be strong enough to support the weight of the jack.

Figure 3:
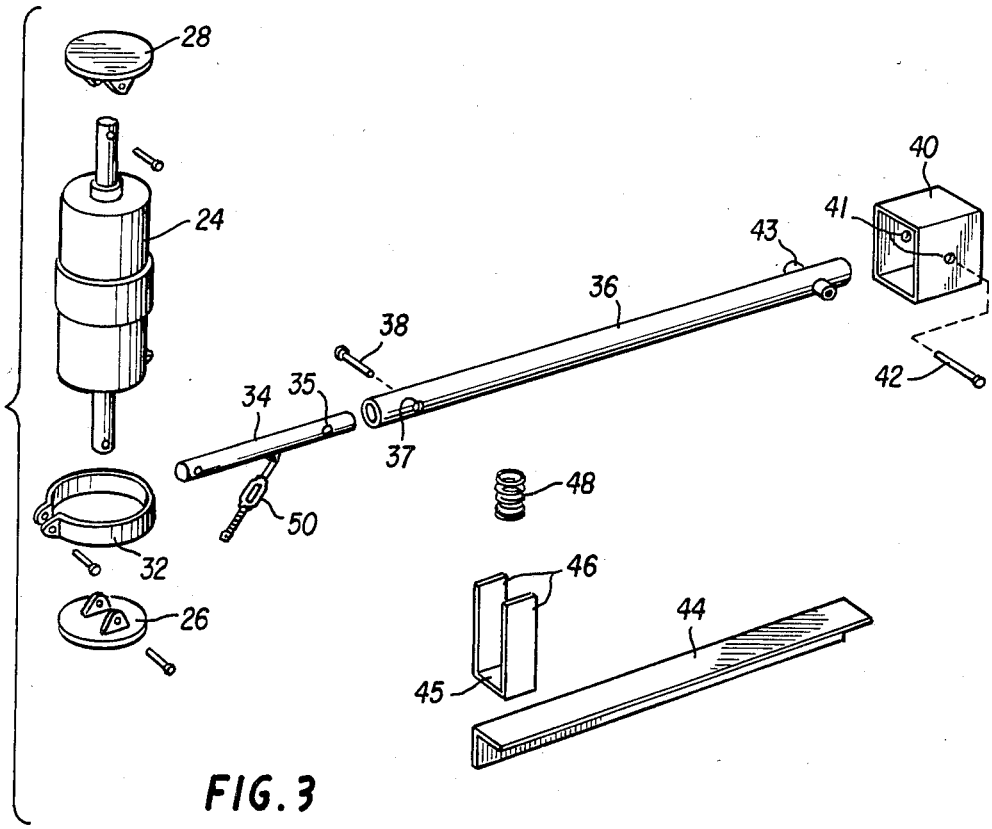
FIG. 3 is an exploded view of FIG. 2.

The clamp 32 is permanently attached, for example by welding, to swivel arm 34. The swivel arm is slipped inside support arm 36 which has an inside diameter slightly larger than the outside diameter of the swivel arm. The two arms are rotatable relative to each other but fit tightly enough together so that the swivel arm is fully supported by the support arm. A hole 35 is formed in the swivel arm and a similar hole 37 is formed in the support arm (see FIG. 3). A swivel pin 38 is inserted through the two holes so that the two arms may not be rotated until it is removed.

A hinge box 40 is permanently mounted, for example by welding or bolting, to the body of the machine 20. The hinge box is formed like a conventional rectangular shaped box of steel or other strong material but with the front and back open. The two side walls have openings 41 (FIG. 3) for receiving a hinge pin 42. The body of the machine may also need to have a hole in line with hole 41 to receive the end of the hinge pin. The end of the support arm contains a hole or transversely arranged pipe 43 which is placed inside the hinge box in line with openings 41. When the hinge pin is inserted, it forms a hinge about which the support arm may rotate in a vertical plane.

A support plate 44 is permanently mounted, for example by welding or bolting to the body of the machine 20. The plate may be a vertical bar or sheet of steel or other strong material but preferably is made of angle steel for more strength. It extends outwardly to a point beneath the support arm. A spring box 45 is mounted on the end of the support plate with sidewalls 46 extending upwardly and generally parallel to the support arm. A spring 48 is placed on the floor of the spring box between the sidewalls.

A turnbuckle 50 extends between the body of the jack and the swivel arm. By tightening or loosening the turnbuckle, the vertical position of the jack may e adjusted.

In operation, when the roof bolter 20 prepares to move, the operator collapses the jack so that it is not in contact with the floor or roof. If the size of the mine requires it, swivel pin 38 may be removed and swivel arm 34 rotated within support arm 36 to turn the jack sideways for easier manuevering. Upon reaching the desired location for placing a new roof bolt, the jack is rotated back into the vertical position and the swivel pin reinserted. The operator then expands the jack until the floor and roof are reached. Once the jack is in place, the operator can proceed with the roof bolting operation without any danger of roof fall. When the operation is complete, the jack is collapsed and the machine moved to the location of the next roof bolt.

When the jack is collapsed, the weight of the ATRS system is borne mostly by the spring box and support plate except for some support by the hinge pin. The support plate is designed to carry this weight without damage to the machine or the jack. The spring provides a shock absorbing effect for the arm when the machine moves from place to place.

Because of the simplicity of the device, it is easily retrofitted to an existing roof bolter by merely attaching the hinge box and support plate to the body of the bolter. The only hydraulic controls necessary are for the jack itself. Since no other hydraulic devices are required, expensive controlling devices are not necessary and installation becomes easier and power requirements remain low. The only alignment of parts necessary in assembling is that the spring box be in line with the support arm. Thus, the device is easily retrofitted.

By using a jack that is relatively small, such as 24 inches collapsed and 50 inches extended, the ATRS system can be used in seams with low roofs. By making the jack rotatable, it is even more manueverable in tight places. For higher roofs it is possible to add extensions to the floor and roof pads or replace the jack with one of greater height. This is easily performed by removing the hydraulic connections and sliding the jack and swivel arm out and replacing them with a new jack and swivel arm arrangement. In other words, the connections to the bolter do not have to be changed for the adjustment.

When the jack is extended, the roof and floor pads will generally not make contact at the same time, since the height of the roof varies from mine to mine. When contact is made, that side of the jack will stop extending until the other pad makes contact. If the jack does move the support arm up or down slightly before the extension is stopped it does no harm since the spring allows the arm to move up or down. In fact, the arm could even move upwardly completely off the spring if desired. The spring absorbs any shock due to the movement of the jack.

The weight of a typical ATRS system of the present invention is about 175 pounds which makes it easy to install and use. It also is not cumbersome or interfere with the roof bolting procedure.

The device may be mounted on either side of the bolter, depending on the configuration of the machines. It is also possible to have a right angle turn on the support arm so that the jack is more directly in front of the machine.

While the swivel arm has been shown as fitting inside the support arm, it is also possible to have the swivel arm fit outside the support arm. In fact, any arrangement of the two parts which makes them relatively rotatable is suitable.

It may be necessary to have another locking mechanism on the swivel arm to prevent it from sliding out of the support arm when transporting the jack after it is rotated. One simple way to do this is to have a second hole through the swivel arm at right angles to the first hole so that the swivel pin may be reinserted after the jack is rotated. Another arrangement could involve interlocking flanges on the two arms.

The invention has been shown as a complete device mounted on a roof bolter. It could also be prepared in kit form to be used for retrofit applications with the major components prepared for easy assembly.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A temporary roof support system for a low roof mining machine, comprising:

a jack;

a swivel arm fixedly connected to said jack;

a support arm having a first end for receiving said swivel arm and a second end;

said swivel arm and said support arm being relatively rotatable so that said jack may be rotated to a horizontal position in a vertical plane transverse to said support arm;

locking means connected to said support arm and said swivel arm to selectively prevent rotation therebetween;

hinge means fixedly attached to said machine, a second end of said support arm being hingedly received therein;

support means supporting said support arm and being fixedly attached to said machine and extending outwardly beneath said support arm;

whereby said system may be retrofitted to said machine easily and whereby said support plate carries said support arm until said jack is extended.

2. A system according to claim 1 further comprising:

spring means mounted on said support plate means for resiliently supporting said support arm.

3. A system according to claim 2 further comprising:

a spring box means mounted on said support plate means and containing said spring means for receiving said support arm.

4. A system according to claim 1 wherein said hinge means is a hinge box with apertures in two opposite vertical faces for receiving a hinge pin.

5. A system according to claim 4 wherein said support arm receives said hinge pin.

6. A system according to claim 1 further comprising:

a leveling means extending between said jack and said support arm to adjust said jack to a vertical position.

7. An automated temporary roof support system for a low roof mining machine, comprising:

a jack;

a foot pad connected to a first end of said jack;

a roof pad connected to a second end of said jack;

a jack clamp engaging said jack at an intermediate position;

a swivel arm fixedly connected to said jack clamp;

a support arm having a first end for receiving said swivel arm and a second end;

said swivel arm and said support arm being relatively rotatable so that said jack may be rotated to a horizontal position in a vertical plane transverse to said support arm;

a removable swivel pin for preventing relative rotation of said support arm and swivel arm;

a hinge box being connected to the frame of said machine for hingedly receiving said second end of said support arm;

a support plate connected to the frame of said machine and extending outwardly therefrom below said support arm;

a spring box mounted on said support plate having upstanding side walls and a spring mounted on the bottom of said box for receiving and supporting said support arm; and a leveling turnbuckle extending between said jack and said swivel arm for adjusting said jack in a vertical direction;

whereby said system may be retrofitted to said machine easily and whereby said support plate carries said support arm until said jack is extended to reach the mine floor.

* * * * *